US006409162B1

(12) United States Patent
Belusko

(10) Patent No.: US 6,409,162 B1
(45) Date of Patent: Jun. 25, 2002

(54) HINGE

(76) Inventor: David Herman Belusko, 10408 James Rd., Rochester, WA (US) 98579

( * ) Notice: Subject to any disclaimer, the term of this patent is extended or adjusted under 35 U.S.C. 154(b) by 46 days.

(21) Appl. No.: 09/669,810

(22) Filed: Sep. 26, 2000

(51) Int. Cl.[7] ..... B25B 1/22

(52) U.S. Cl. ..... 269/71; 269/279; 269/247; 269/252; 269/282

(58) Field of Search ..... 269/268, 71, 252, 269/282, 241, 279, 247, 286

(56) References Cited

U.S. PATENT DOCUMENTS 1,488,559 A * 4/1924 Simokaitis ..... 269/71
3,675,916 A * 7/1972 Kartasuk et al. ..... 269/252
4,133,519 A * 1/1979 Shin et al. ..... 269/247

* cited by examiner

*Primary Examiner*—Joseph J. Hail, III
*Assistant Examiner*—Lee Wilson

(74) *Attorney, Agent, or Firm*—Kenneth W. Thomas

(57) ABSTRACT

In accordance with this invention an eccentrically immobilized hinge-type device is provided having a yoke shaped hinging element with cylindrical peripheral surfaces and a channel shaped hinging element with an eye-ended connecting rod, and a relatively eccentric hinge-pin. The cylindrical peripheral surfaces of the yoke shaped hinging element seats in the channel shaped hinging element and both elements pivot on the relatively eccentric hinge-pin which penetrates the bore of the yoke and the eye-end bore of the connecting rod. The eccentric hinge-pin is connected to an activating means that controls the eccentrically applied tension on the connecting rod, consequently the friction between the cylindrical peripheral surfaces of the yoke shaped hinging element and the seat of the channel shaped hinging element, thus affecting hinging ability. The channel shaped hinging element, when functioning with a simple dual cylindrical peripheral element yoke, can have a rotational element with an axis perpendicular to the pivoting axis, thus permitting the eccentrically immobilized hinge-type device to be rotatable about this axis concurrent with hinging mobilization, or rotationally immobilized concurrent with hinging immobilization.

9 Claims, 10 Drawing Sheets

13
71
11
10
202
12
44
74
18
204
62
61
201
30
26
19
24
72
23
17
39
20
22
28
23
70
50
56
64
52
55
68
60
66
53
58
57
46
45
48
40
36
32
34
42
38
54
49

13
71
304
11
10
302
324,326
316
315
322
12
74
318
312
321
303
313
314
305
72
308
306
311
301
320
60
57
70
55
64
56
68
58
66
56
309
32
46
45
48
40
42
36
38
310
34

HINGE

CROSS-REFERENCE TO RELATED APPLICATIONS, IF ANY

Not applicable.

STATEMENT REGARDING FEDERALLY SPONSORED RESEARCH OR DEVELOPMENT

Not applicable.

REFERENCE TO A MICROFICHE APPENDIX, IF ANY

Not applicable.

This invention relates to an immobilizable hinge and, more particularly, to an implement positioner which can be positioned and effectively locked.

BACKGROUND OF THE INVENTION

A hinge always has three fundamental elements, two hinging elements and a hinge-pin about which the hinging elements may pivot. It is highly desirable to have the hinge-pin's radial surface(s) not only disposed for pivoting but also disposed for frictional immobilization of the hinging elements. Accordingly there exists a need to provide an eccentric means associated with the hinge-pin for affecting the aforementioned functions. In addition, it is also desirable to have a hinge, such as described above, in which the hinging elements can be pivotally immobilized and the hinge can be rotated and immobilized about an axis perpendicular to the pivoting axis, and all of this being accomplished by a single actuating element. To the best of my knowledge the prior art does not disclose the aforementioned combinations.

SUMMARY OF THE INVENTION

Therefore, in accordance with this invention, an eccentrically immobilized hinge-type device is provided comprising a yoke-type device having peripheral elements radially centered, with each of the elements housing a bore, an eccentric device having radially centered elements disposed for cooperating with the bore of the yoke-type device and having an eccentric element, a connecting device disposed for cooperating with the eccentric device's eccentric element and the yoke-type device's peripheral elements, and an activating means for the eccentric device, such that upon activation it controls the hinging ability between the yoke-type device and the connecting device.

Therefore, an object of this invention is to provide an eccentrically immobilized hinge-type device which can tilt an implement coupled to it and simultaneously completely rotate the implement about an axis perpendicular to the axis of tilt and simultaneously immobilize both the tilting and rotating attributes with relatively minimal actuating means force torsionally applied to a single eccentric device.

Another object of this invention is to provide an eccentrically immobilized hinge-type device which can be comfortably, receptively, hand operated because the actuating means force, especially in the case of a rolling/needle bearing eccentric device, is minimal relative to the powerful eccentrically produced immobilization force that prevents break-away (slippage) between the yoke-type device's peripheral elements and the connecting device's abutting surfaces.

A further object of this invention is to provide an eccentrically immobilized hinge-type device which employs the eccentric device to rotate as a unit with the hinge-type device, thus assuring that a coupled implement cannot be rotated and/or tilted into a position of mutual interference with the actuating means for the eccentric device.

Still another object of this invention is to provide an eccentrically immobilized hinge-type device which is a low profile design because the eccentric device is internal to the yoke-type device as opposed to it being external, which, for such a device, would necessitate additional parts/space and an overall dimension increase.

A further object of this invention is to provide an eccentrically immobilized hinge-type device which can be easily adjusted for ware between the yoke-type device and the eccentric device, and the connecting device, because a single adjustment element is intrinsic to the design of the connecting device.

Still another object of this invention is to provide an eccentrically immobilized hinge-type device which is environmental contamination resistant because the eccentric device's immobilization working surfaces are internal to the yoke-type device and the connecting device.

A further object of this invention is to provide an eccentrically immobilized hinge-type device which can be easily disassembled for maintenance or repair because it can be equipped with a keying element that can be removed by removing one fastener.

Still another object of this invention is to provide an eccentrically immobilized hinge-type device which employs the yoke-type device and the connecting device for instillation of a caliper-type tilt-brake.

A further object of this invention is to provide an eccentrically immobilized hinge-type device which employs the eccentric device and the connecting device for instillation of a safety lock to prevent inadvertent engagement or disengagement of the eccentric device.

Still another object of this invention is to provide an eccentrically immobilized hinge-type device which is structurally and functionally heavy duty relative to the hinge-type device's size and construction materials.

BRIEF DESCRIPTION OF THE DRAWINGS

The accompanying drawings, which are incorporated and form a part of the specification, illustrate the present invention, and, together with the description serve to explain the principles of the invention. In the drawings.

DETAILED DESCRIPTION OF THE INVENTION

The "eccentrically immobilized hinge-type device" hereinafter will be referred to as the "hinge-type device."

Figure 1:
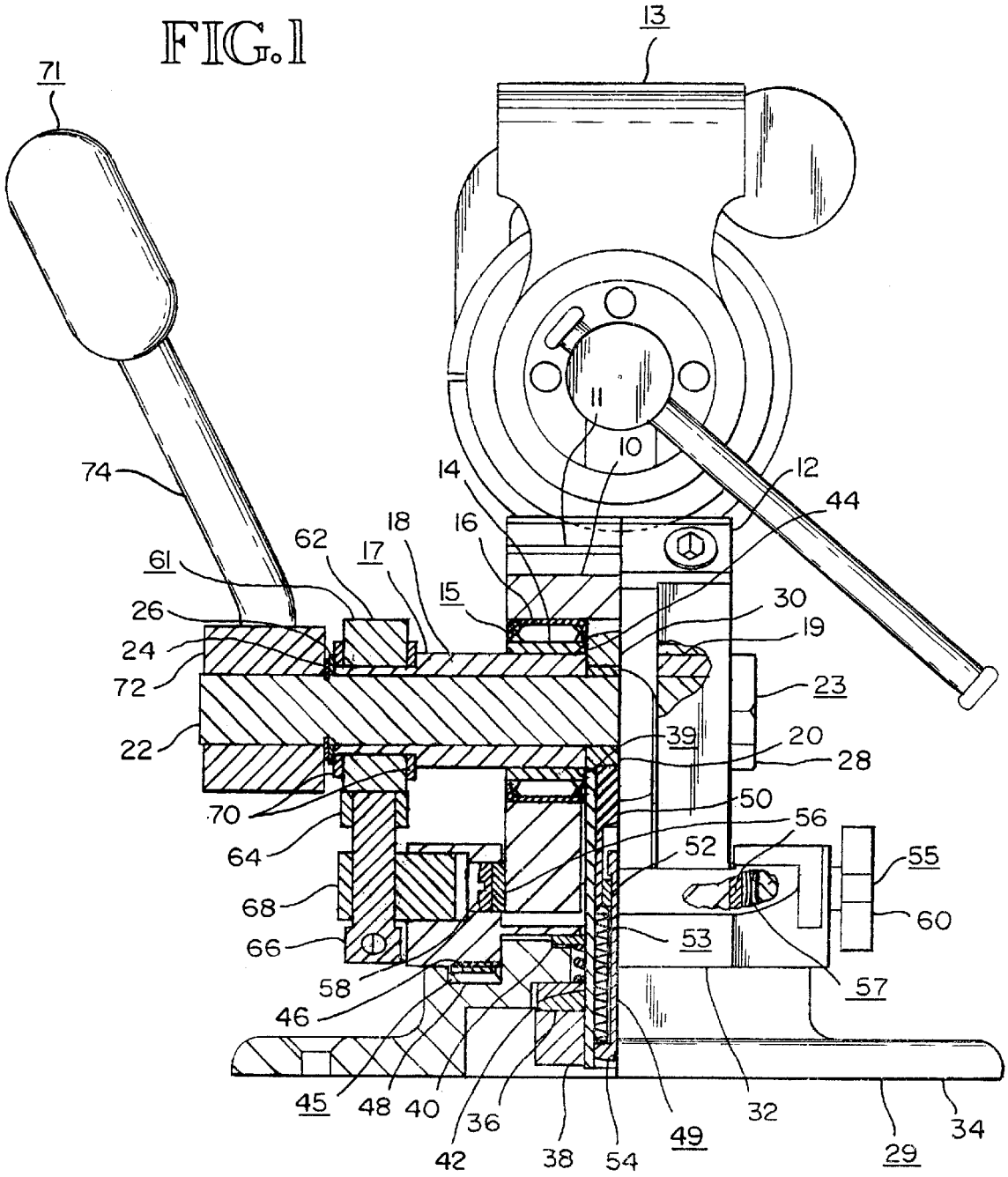
FIG. 1 is a front view with a partial cutaway of the eccentrically immobilized hinge-type device embodying the teachings of the invention, and showing the positioning of the components of a mobilized hinge-type device with needle bearing assemblies with inner races and an eccentric device penetrated by a hex shaft with its axis central to the bore of a yoke while eccentric to the eye-end bore of a connecting rod.
Figure 2:
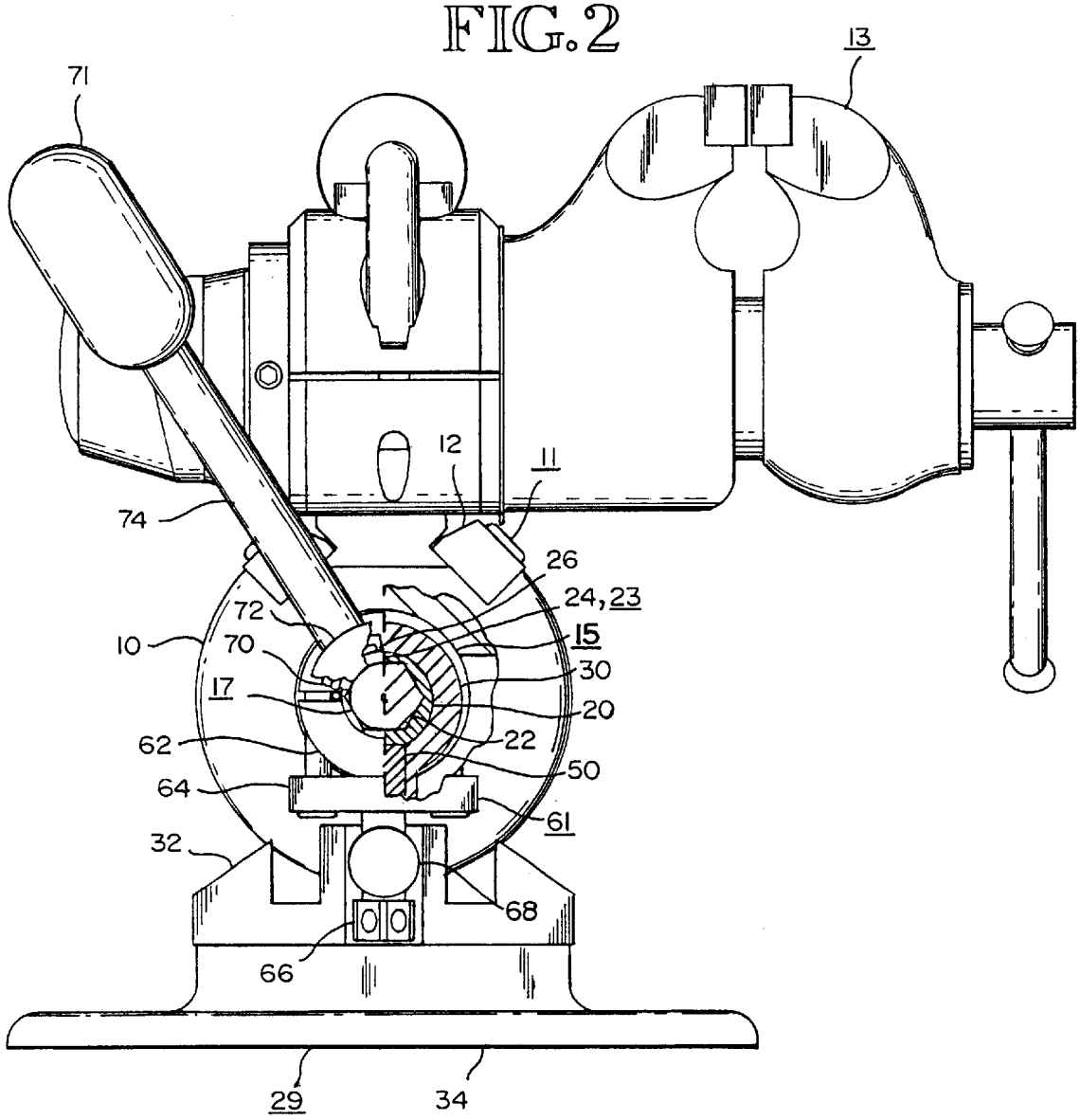
FIG. 2 is a side view with a partial cutaway of the apparatus of FIG. 1.
Figure 9:
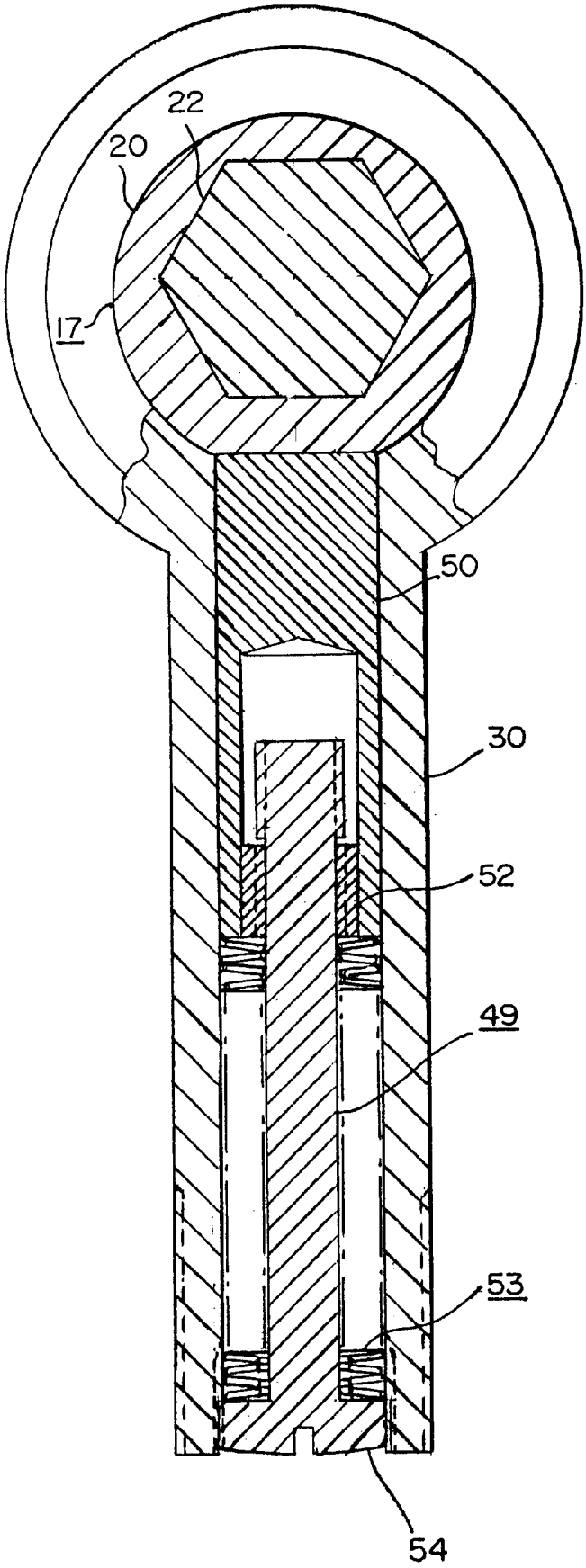
FIG. 9 is a diagram with a partial cutaway of the eccentrically immobilized hinge-type device's connecting rod with detent device of the apparatus of FIGS. 1, 2, and 4 embodying the teachings of the invention, and showing the positioning of the components of the detent device in the hinge-type device's mobilized position.

The preferred embodiment of the hinge-type device as illustrated in FIGS. 1, 2, and 9 is comprised of: a yoke-type device 10 having peripheral elements radially centered on said yoke-type device's axis, with each element housing a bore on the axis, and the yoke-type device has an implement coupling element 11; anti-friction needle bearing assemblies 15 with all the bearing assemblies 15 individually having a radially outermost element 16 disposed for securely cooperating with a bore of the yoke-type device 10; an eccentric device 17, having first peripheral elements 18,19 radially centered on an axis, with all the peripheral elements 18,19 individually disposed for securely cooperating with a radially innermost element 14 of a bearing assembly 15, and the eccentric device has an eccentric peripheral element 20 disposed adjacent to first peripheral elements 18,19 and disposed for cooperating with a keying element 22 with an axis central to the first peripheral elements 18,19 and the keying element 22 retaining radial alignment of all the peripheral elements 18,19,20; an eccentric device element retaining apparatus 23 comprised of a snap-ring 24 and a flat washer 26 and a nut 28; a connecting device 29, disposed for cooperating with the eccentric peripheral element 20 of the eccentric device 17 and all the peripheral elements of the yoke-type device, and comprised of a connecting rod 30 and a saddle 32 and an implement coupling element 34 and a two-piece spherical washer 36 and a threaded clamping collar 38; a connecting device seal apparatus 39 comprised of a seal washer 40 with a biasing coil spring 42 and an o-rings 44; a rotation anti-friction device 45 comprised of a thrust washer 46 and a wave spring 48; a detent device 49 comprised of a plunger 50 and a threaded retaining bushing 52 and a belleville spring washer assembly 53 and a captive adjustment screw 54; a tilt braking device 55 comprised of braking pads 56 and a belleville spring washer assembly 57 and slotted adjustment screw 58 and an adjustment knob 60; a safety locking device 61 comprised of a two piece collar 62 and a nut bar 64 and a shoulder bolt 66 and a self adjusting bolt-retainer 68 and seal washers 70; and an activating means 71, comprised of a clamping collar 72 and a lever-handle 74, for the eccentric device 17, such that, upon activation it controls the hinging ability between the yoke-type device 10 and said connecting device 29.

The yoke-type device 10 is one piece construction, however it can be constructed from three pieces by fastening, on a common axis, two axially bored, cylindrical legs to a cooperating plate designed to also cooperate with specific implement coupling requirements. The yoke-type device's 10 axial bores function as gudgeons in cooperative descending radial sequence with the outermost element 16 of the anti-friction needle bearing assemblies 15, the eccentric device's first peripheral elements 18,19, and the eccentric device's hex keying element 22. In-between the yoke-type device's 10 peripheral elements is axial-bore space providing adequate clearance for free eccentric movement of the eye-end of the connecting rod 30. The radially centered, cylindrical, peripheral elements of the yoke-type device 10 cooperate with a channel shaped seat of the saddle 32, while the yoke-type device's 10 axial sides cooperate with the saddle's 32 braking pads 56.

The implement coupling element 11 is comprised of two clamp-type retaining bars 12 cantilevered at equal angles over a flat surface on a peripheral segment of the yoke-type device 10, thus forming a female dovetail socket that cooperates with a similar male dove-tailed coupling element of an implement as shown in FIGS. 1 through 8 by the example of a turret vice assembly 13.

The anti-friction needle bearing assemblies 15 function to provide minimum friction between the bore of the yoke-type device 10 and the eccentric device's first peripheral elements 18,19. The minimal friction functions to maximize the eccentrically applied hinge-type device immobilization stress for a given force applied to the actuating means 71 and functions to minimize the necessary force applied to the actuating means 71 to break-away from the static friction between the needle bearings and their inner and outer races which facilitates mobilization by unloading stress on the hinge-type device. The anti-friction needle bearing assemblies 15 have high load capacity per rolling bearing element diameter which is desirable to minimize bearing ware and can have a non-separable or separable inner race.

The eccentric device 17 functions to control connecting rod 30 tension by either loading stress which determines the strength of immobilization of the hinge-type device's tilting and rotating features, or unloading stress to mobilize the hinge-type device's tilting and rotating features. The eccentric device's 17 eccentric peripheral element 20 cooperates with the eye-end bore of the connecting rod 30. When the eccentric device is rotated in either direction it's eccentric peripheral element 20 approaches maximum eccentricity which tensions the connecting rod 30 and concurrently causes compression in the effected areas of the keying element 22 and the first peripheral elements 18,19 and the needle bearing assemblies 15 and the yoke-type device's 10 peripheral elements and the saddle 32 and the implement coupling element 34 and the two piece spherical washer 36 and the threaded clamping collar 38. The eccentric device's hex keying element 22 axially penetrates, in slip-fit sequence, the longer of the two eccentric device's first peripheral element 18, the offset axis of the eccentric peripheral element 20, and the second, shorter, first peripheral element 19. The slip-fitting hex keying element 22 also facilitates instillation of the connecting device sealing o-rings 44 with minimum stretching onto the first peripheral elements 18, 19 and facilitates assembly of the connecting device's connecting rod 30 in-between the peripheral elements of the yoke-type device 10 for cooperation with the eccentric device's 17 eccentric peripheral element 20. The eccentric device's 17 elements 18,19,20 are retained on the activating means 71 end of the hex keying element 22 by the snap ring 24 and the flat washer 26 and on the other end by the (interference fit) nut 60. The eccentric device's 17 first peripheral element 18 cooperates with the safety locking device by means of a reduced diameter on its closest end to the activating means 71. The handled activating means 71 clamping collar 72 cooperates with a diameter on the eccentric device's 17 hex keying element 22.

The connecting device 29 functions to distribute energy originating as torque to the activating means 71 and eccentric device 17 to the hinge-type device by means of its connecting rod 30 which has an eye-end bore that cooperates with the eccentric device's eccentric element 20, and has a shank that cooperates with the threaded clamping collar 38 that retains the hinge-type device assembly and adjusts operating clearance, the two-piece spherical washer 36, the implement coupling element 34, and the saddle 32 whose channel shaped side cooperates with the yoke-type device's 10 outer peripheral elements.

The connecting device sealing apparatus 39 function to maintain relatively contamination free cooperating surfaces between the eccentric device's eccentric peripheral element 20 and the eye-end bore of the connecting device's connecting rod 30 by means of two o-rings 44, and between the saddle 32 and the implement coupling element 34 and the two piece spherical washer 36 by means of the seal washer 40 with biasing coil spring 42. The seal washer 40 cooperates with the saddle 32 and the biasing coil spring 42 cooperates with the two piece spherical washer 36.

The rotation anti-friction device 45 functions to minimize friction between the saddle 32 and the implement coupling element 34 by means of the thrust washer 46 and wave spring 48 permitting smooth rotation of the hinge-type device. The thrust washer 46 is secured to a cooperating surface of the saddle 32 and cooperates with the with the wave spring 48 that cooperates with the implement coupling element 34. The rotation anti-friction device 45 has no practical negative affect on rotational immobilization because it functions radially inside the cooperating area where friction between the saddle 32 and the implement coupling element 34 functions to immobilize the rotation of the hinge-type device.

The detent device 49 is housed in the connecting device's connecting rod 30 and functions to position the eccentric device's 17 eccentric element 20 for hinge-type device mobilization. Detenting is accomplished by means of a peripheral surface flat centered on the plane of the longest radii of the eccentric element 20 in cooperation with a solid flat end of the plunger 50 that cooperates with an axial bore in the shank of the connecting rod 30 and biasing belleville spring washer assembly 53. The plunger 50 has an axial hole in its opposite end from the flat that securely cooperates with the smooth outside diameter of the threaded retaining bushing 52 and has excessive depth to allow for adequate slip cooperation between the shank of the captive adjustment screw 54 and the inside threads of the threaded retaining bushing 52 concurrently with slip cooperation between expanded threads at the tip of the shank of the captive adjustment screw 54 and the bore, a condition necessary to facilitate adjustment of the detent device. The detent device 49 can be installed or removed from the connecting rod 30 as a unit because the belleville spring washer assembly 53 on the reduced diameter shank of the captive adjustment screw 54 are held captive by the plunger's 50 threaded retaining bushing 52. The head of the captive adjustment screw 54 is threaded to cooperate with a partially threaded section of the axial bore at the shank's end of the connecting rod 30 and the head is slotted to cooperate with a screwdriver to facilitate adjustment of the detent device's 49 belleville spring washer assembly 53.

The tilt braking device 55 is housed in the connecting device's saddle 32 and functions to apply frictional drag by means to two braking pads 56 on the two outermost axial sides of the cooperating yoke-type device 10. The braking feature is desirable to prevent inadvertent tilting of the yoke-type device due to a coupled implement's overhung load when the hinge-type device is mobilized. The amount of frictional drag is controlled by the adjustment knob 60 that functions to vary the compression of the belleville spring washer assembly 57 that cooperates with one of the two braking pads 56. The second braking pad 56 is positioned on the same axis as the first braking pad 56 but on the opposite inner side of the (channel shaped) saddle 32 and it cooperates with the slotted adjustment screw 58 to axially position the yoke-type device 10 for clearance with the two cooperating inside surfaces of the (channel shaped) saddle 32.

The safety locking device 61 functions to secure the eccentric device 17 relative to the connecting device 29 such that an inadvertent force applied to the handled activating means 71 will not be transferred to the connecting device's 29 connecting rod 30, thus minimizing the possibility of mobilization of an immobilized hinge-type device. The safety locking device's two piece collar 62 cooperates with the reduced diameter of the eccentric device's 17 first peripheral element 18, and cooperates on its two sides with the seal washers 70, and cooperates with the nut bar 64 by means of two socket head screws with shanks that loosely penetrate the nut bar 64 and the half of the two piece collar 62 that is closest to the nut bar 64 and then the socket head screws are secured into the other threaded half of the two piece collar 62, and cooperates with the shoulder bolt 66 which screws through the nut bar 64 contacting the half of the two piece collar 62 closest to it. The shoulder bolt's 66 shoulder acts as a torque-arm by loosely cooperating with a radial hole in the self-adjusting bolt-retainer 68 which cooperates with a slip-fit hole in the side of the connecting device's 29 saddle 32, in addition, these two parts function to allow adjustment for manufacturing tolerances. The shoulder bolt's 66 head has two perpendicular through holes drilled in it, each of which cooperates with a hand inserted rod used to turn the shoulder bolt 66 and screw it into, or out of, the nut bar 64. Screwing the shoulder bolt 66 into the nut bar 64 pushes one half of the two piece collar 62 against the reduced diameter of the eccentric device's 17 first peripheral element 18 and concurrently pulls the nut bar 64 in the opposite direction which pushes on the heads of the two socket head screws that penetrate it, thus pulling the other half of the two piece collar 62 against the reduced diameter of the eccentric device's 17 first peripheral element 18. The pushing and pulling of the opposite halves of the two piece collar 62 clamp it around the reduced diameter of the eccentric device's 17 first peripheral element, consequently securely locking the hinge-type device.

The handled activating means 71 functions to accommodate hand operation of the eccentric device 17 and by rotating it approximately forty-five degrees, in either direction, the hinge-type device can be immobilized or mobilized and free to hinge through one hundred eighty degrees and fully rotate. The handled activating means 71 lever handle 74 is clamped to the diameter portion of the eccentric device's hex keying element 22 by means of a split clamping collar 72.

Figure 3:
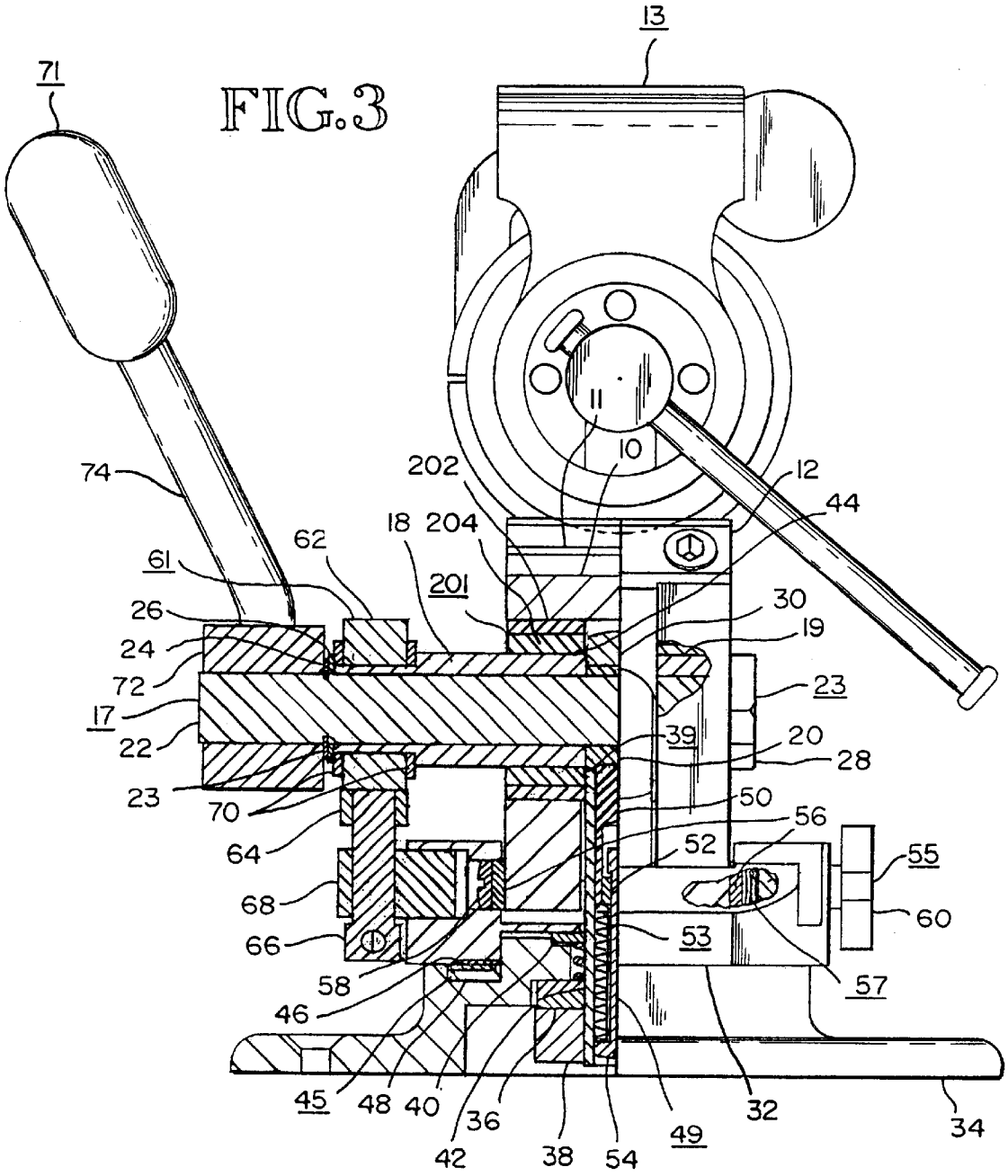
FIG. 3 is a front view with a partial cutaway of the eccentrically immobilized hinge-type device embodying the teachings of the invention, and showing the positioning of the components of a mobilized hinge-type device with dual sleeve bushing assemblies and an eccentric device penetrated by a hex shaft with its axis central to the bore of a yoke while eccentric to the eye-end bore of a connecting rod.
Figure 4:
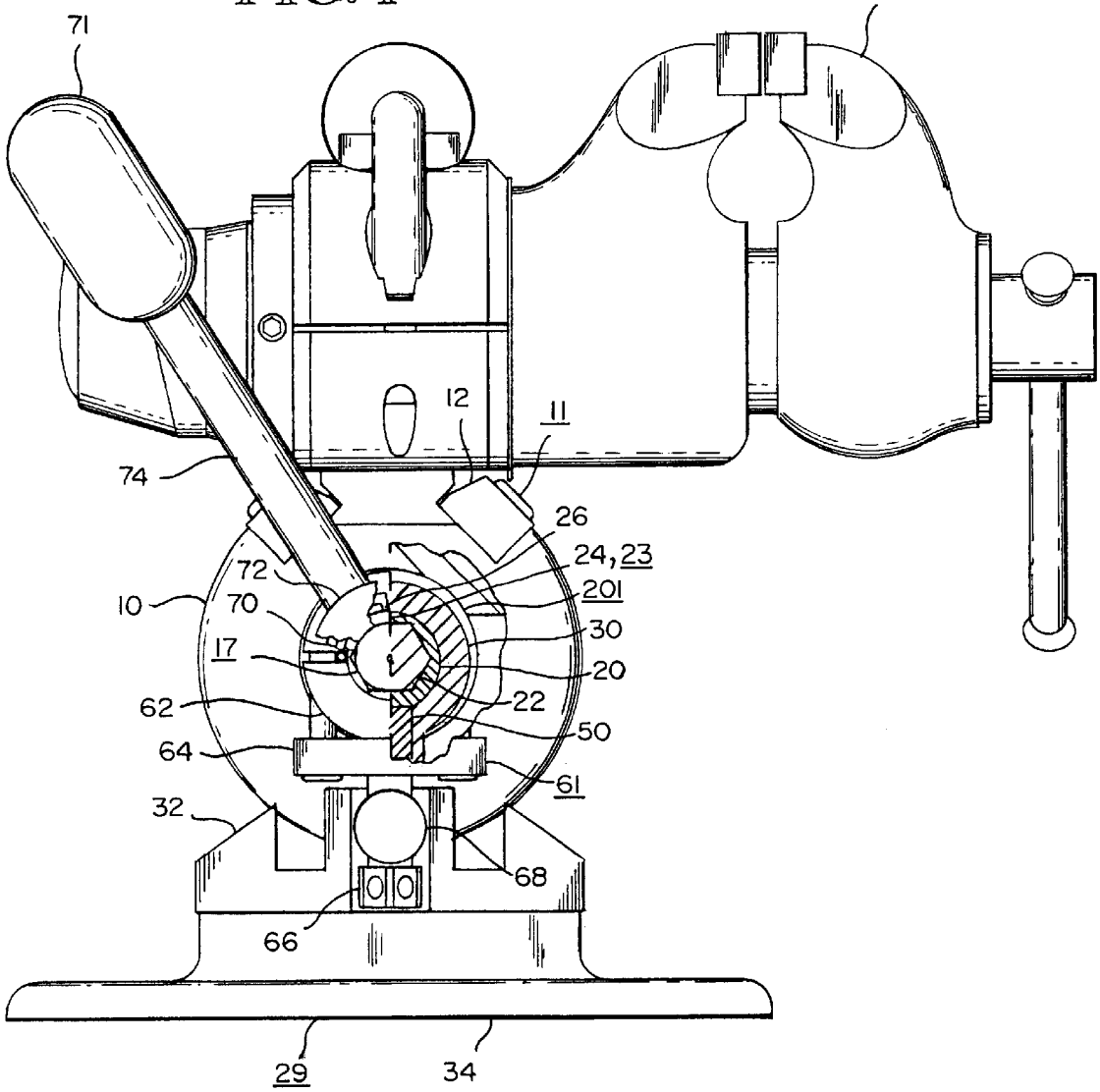
FIG. 4 is a side view with a partial cutaway of the apparatus of FIG. 3.

FIGS. 3, 4, and 9 illustrate another embodiment of the hinge-type device in which like components of FIGS. 1, 2, and 9 have been given the same reference numbers. The distinction between FIGS. 3, 4, and 9, and FIGS. 1, 2, and 9, is anti-friction dual sleeve bushing assemblies 201, each comprised of a bushing 202 and a bushing 204, with half the number of bushings 202 individually disposed for securely cooperating with a bore of the yoke-type device. The eccentric device 17, has first peripheral elements 18,19 radially centered on an axis, with all the peripheral elements individually disposed for securely cooperating with a bore of the second half of the number of bushings 204 that are individually disposed for cooperating with a bore of the first half of bushings 202. The desired hinge-type device immobilization or mobilization characteristics are dependent on the relative thickness of bushings 202 and 204. This is because the resulting torque on the eccentric device 17 from an applied force to the handled activating means 71 opposes friction between the cooperating elements 201,202 and the larger the radius of frictional engagement the greater the required break-away torque on the eccentric device 17 to overcome the friction. If it is desirable to have a hinge-type device that is somewhat self-locking, making mobilization of an immobilized hinge-type device less likely to occur by an inadvertent torquing force to the activating means 71, bushings 202 would be thin (or nonexistent) and bushings 204 would be thick. Conversely, if less torque to the activating means 71 is desirable to mobilize an immobilized hinge-type device, bushings 202 would be thick and bushing 204 would be thin (or nonexistent). Since the activating means 71 force depends on the frictional break-away torque of the dual sleeve bushing assemblies 201, it can be modified through the material selection of bushings 204 and/or 202, or the yoke-type device 10 in the case of an nonexistent bushing 202, or the first peripheral elements 18,19 in the case of a nonexistent bushing 204, or through material hardening or plating. For example, selecting harder, relatively less compressible materials, such as those with a Brinnel Hardness (10-mm tungsten carbide ball, 3,000 kg. load) greater than 223 would cause the frictional break-away torque and consequently the force applied to the activating means 71 to be smaller than if softer, relatively more compressible materials were selected, such as those with a Brinnel Hardness (10-mm tungsten carbide ball, 3,000 kg. load) within the range of 165–223 or those with a non-metallic Shore Hardness greater than D60. Otherwise, the apparatus of FIGS. 3, 4, and 9 functions in a manner similar to that of the apparatus of FIGS. 1, 2, and 9.

Figure 5:
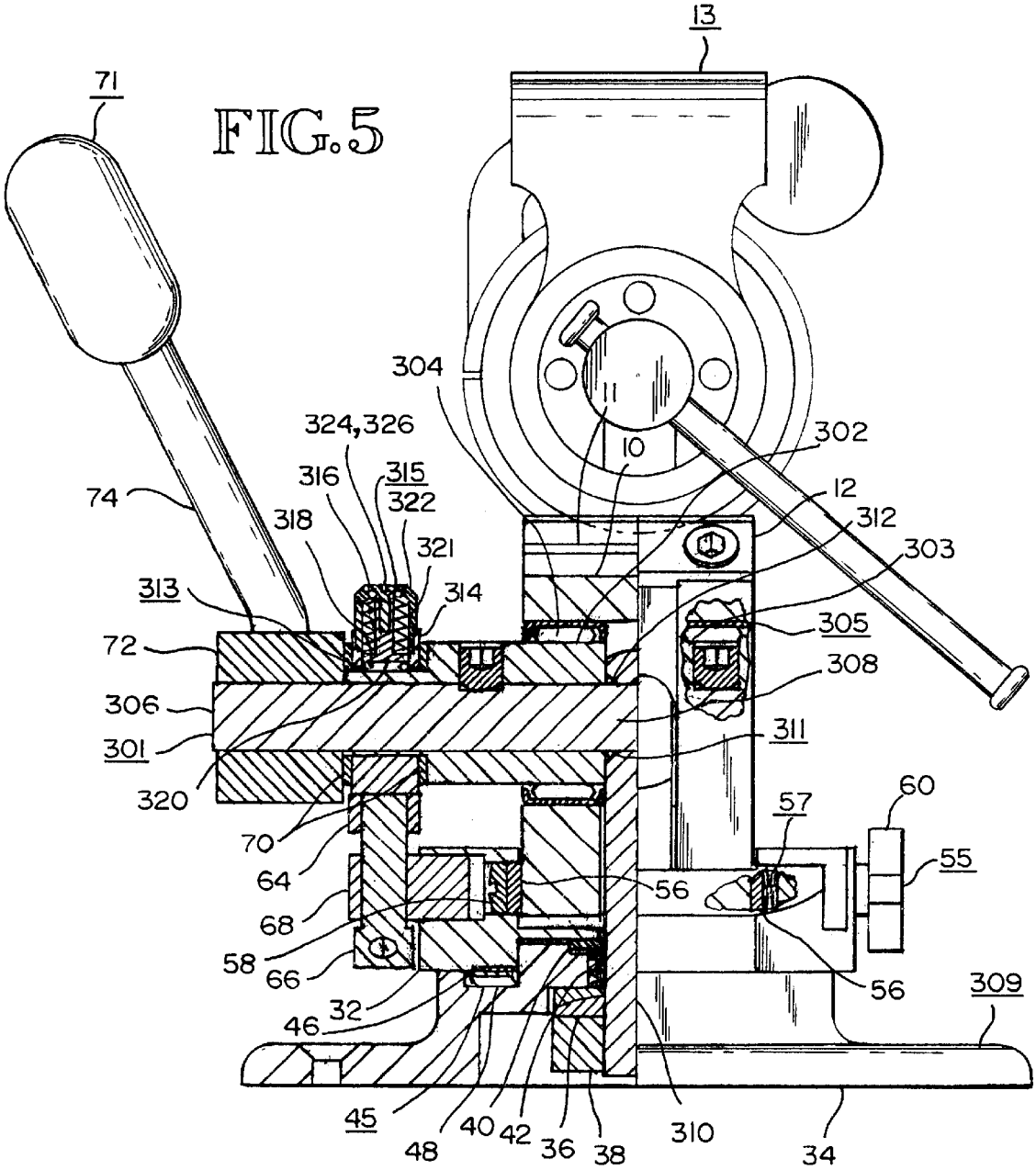
FIG. 5 is a front view with a partial cutaway of the eccentrically immobilized hinge-type device embodying the teachings of the invention, and showing the positioning of the components of a mobilized hinge-type device with needle bearing assemblies without inner races and an eccentric device penetrated by a round set-screwed shaft with its axis eccentric to the bore of a yoke while central to the eye-end bore of a connecting rod.
Figure 6:
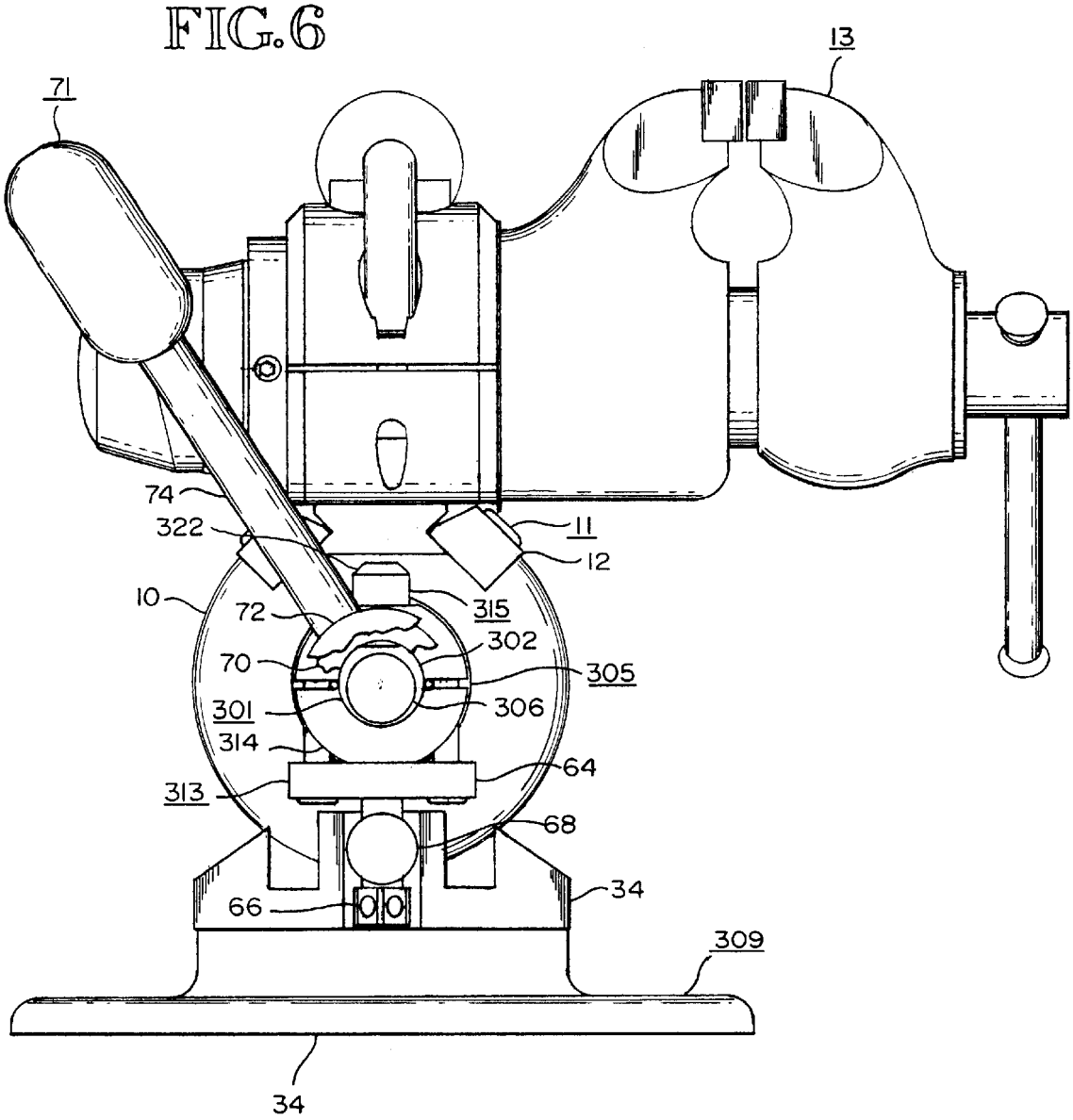
FIG. 6 is a side view of the apparatus of FIG. 5.
Figure 10:
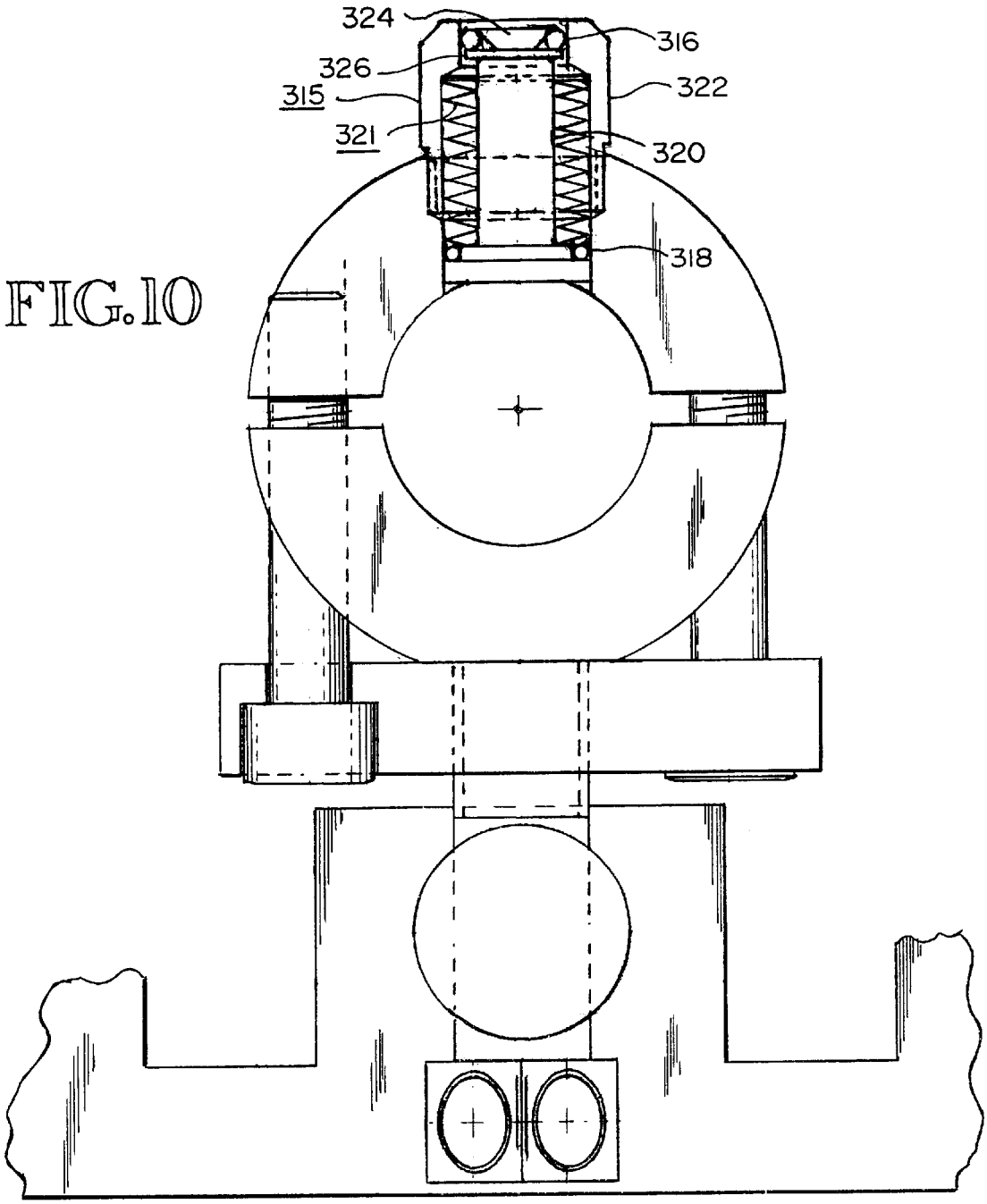
FIG. 10 is a diagram with a partial cutaway of the eccentrically immobilized hinge-type device's safety lock with detent device of the apparatus of FIG. 3 embodying the teachings of the invention, and showing the positioning of the components of the detent device in the hinge-type device's mobilized position.

FIGS. 5, 6, and 10 illustrate still another embodiment of the hinge-type device in which like components of FIGS. 1, 2, and 9 have been given the same reference numbers. The distinction between FIGS. 5, 6, and 10, and FIGS. 1, 2, and 9, is that an eccentric device's 301 first peripheral elements 302,303 cooperate with the needle rollers 304 of needle bearing assemblies 305, and that the eccentric device 301 has an offset axis which is penetrated by keying element 306 which is a round shaft secured to the first peripheral elements 302,303 by radial alignment retaining set-screws. The segment of keying element 306 in-between the first peripheral elements 302,303 functions as an eccentric peripheral element 308 which cooperates with the eye-end bore of a connecting device's 309 connecting rod 310. The connecting device seal apparatus 311 o-rings 312 cooperate with the sides of the eye-end bore of the connecting rod 310, the eccentric peripheral element 308 and the first peripheral elements 302,303. The longer eccentric device's 301 first peripheral element 302 has a reduced diameter on its side facing the handled activating means 71 which cooperates with an axial bore of a safety locking device's 313 two piece clamping collar 314 and has a flat surface centered on the plane of its largest radii which cooperates with a detent device 315 that is screwed into a partially threaded radial bore in one piece of the two piece clamping collar 314. The detent device 315 replaces the detent device 49 as shown in FIGS. 1, 3, 7, and 9. The detent device 315 is a flat-faced, reduced shank, sintered metal, o-ringed 316,318, detent plunger 320 with a belleville spring assembly 321 bias that cooperates with the detent device's 315 cap-housing 322 and is retained on the plunger 320 by a flat socket head screw 324 with a flat washer 326. The o-ring 316 cooperates with the cone shaped head of the flat socket head screw's 324, and the flat washer 326, and an axial hole through the cap end of the cap-housing 322. The o-ring 318 cooperates with the detent device's 315 plunger 320 toward its flat-faced end, and cooperates with the end of the belleville spring assembly 321 and the radial bore of the two piece clamping collar 314. When the detent device 315 is fully assembled, the flat socket head screw 324 is temporarily removed and the bore cavity formed by the union of the bore of the cap-housing 322 and the equivalent diameter radial bore in the two piece clamping collar 314 is filled with light weight oil which penetrates the sintered metal plunger 320 and very sparingly oils its flat faced surface that cooperates with the flat on the reduced diameter of the eccentric device's 301 first peripheral element 302. Otherwise, the apparatus of FIGS. 5, 6, and 10 functions in a manner similar to that of the apparatus of FIGS. 1, 2, and 9.

Figure 7:
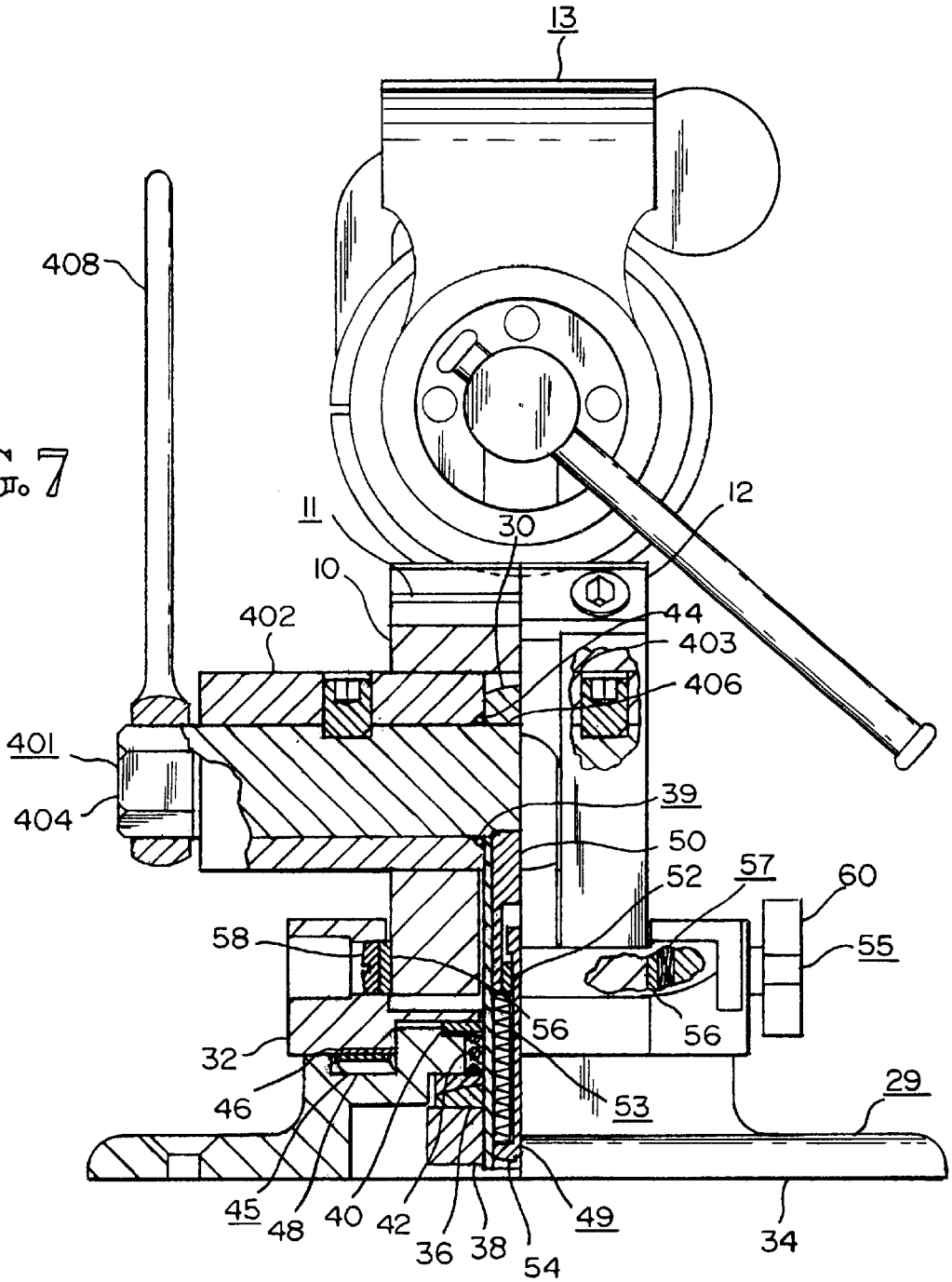
FIG. 7 is a front view with a partial cutaway of the eccentrically immobilized hinge-type device embodying the teachings of the invention, and showing the positioning of the components of a mobilized hinge-type device without bearing assemblies and with an eccentric device penetrated by a round set-screwed shaft with its axis eccentric to the bore of a yoke while central to the eye-end bore of a connecting rod.
Figure 8:
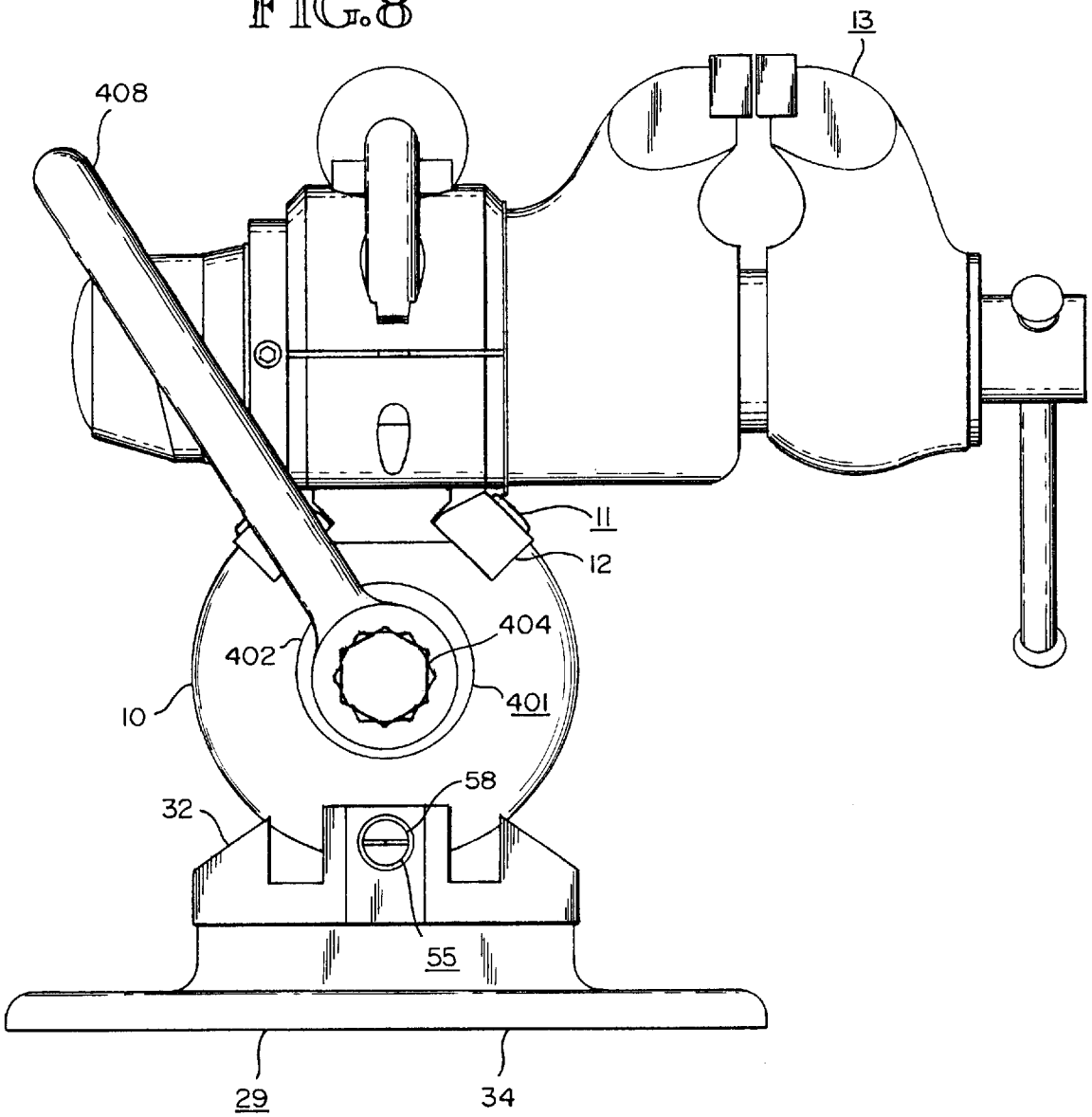
FIG. 8 is a side view of the apparatus of FIG. 7.

FIGS. 7 and 8 illustrate yet another embodiment of the hinge-type device in which like components of FIGS. 1, 2, and 9 have been given the same reference numbers. The distinction between FIGS. 7 and 8, and FIGS. 1, 2, and 9, is that the eccentric device's 401 first peripheral elements 402,403 cooperate with the bore of the yoke-type device 10, and that the eccentric device 401 has an offset axis which is penetrated by keying element 404 which is a hex-headed round shaft secured to the first peripheral elements 402,403 by radial alignment retaining set-screws. The segment of keying element 404 in-between the first peripheral elements 402,403 functions as an eccentric peripheral element 406 which cooperates with the eye-end bore of the connecting device's 29 connecting rod 30. The hex-head of the keying element 404 cooperates with an activating means 408 which is a hex socket device, such as the example in FIGS. 7 and 8 of a hex socket wrench. The eccentric peripheral element 406 has a flat surface centered on the plane of the shortest radii of the eccentric device's 401 first peripheral elements 402,403 that cooperates with the solid flat end of the detent device's 49 plunger 50. A safety locking device, such as 61 in FIGS. 1, 2, 3, and 4, and 313 in FIGS. 5, 6, and 10, is not necessary because the force necessary to brake-away from the static friction between the eccentric device's 401 first peripheral elements 402,403 and the bore of the yoke-type device 10 is relatively high compared to when needle bearing assemblies, such as 15 in FIGS. 1 and 2, and 305 in FIGS. 5 and 6, are installed. The material type, or material hardening or plating of the cooperating surfaces between the eccentric device's 401 first peripheral elements 402,403 and the yoke-type device 10 will effect their surface coefficient of friction and mutual contact static friction, consequently the hinge-type device's activating means 408 force necessary to break-away from that, self-locking, contact friction. For example, selecting softer, relatively more compressible materials, such as those with a Brinnel Hardness (10-mm tungsten carbide ball, 3,000 kg. load) within the range of 165–223 or those with a non-metallic Shore Hardness greater than D60 would cause the frictional break-away torque and consequently the force applied to the activating means 408 to be larger than if harder, relatively less compressible materials were selected, such as those with a Brinnel Hardness (10-mm tungsten carbide ball, 3,000 kg. load) greater than 223. Otherwise, the apparatus of FIGS. 7 and 8 function in a manner similar to that of the apparatus of FIGS. 1, 2, and 9.

The apparatus embodying the teachings of this invention has several advantages over the prior art. For instance, the eccentrically immobilized hinge-type device can tilt an implement coupled to it through one hundred and eighty degrees and simultaneously completely rotate the implement about an axis perpendicular to the axis of tilt and simultaneously immobilize both the tilting and rotating attributes with relatively minimal actuating means force torsionally applied to a single eccentric device. It can be comfortably, receptively, hand operated because the actuating means force, especially in the case of a rolling/needle bearing eccentric device, is minimal relative to the powerful eccentrically produced immobilization force that prevents break-away (slippage) between the yoke-type device's peripheral elements and the connecting device's abutting surfaces. It employs the eccentric device to rotate as a unit with the hinge-type device, thus assuring that a coupled implement cannot be rotated and/or tilted into a position of mutual interference with the actuating means for the eccentric device. It is a low profile design because the eccentric device is internal to the yoke-type device as opposed to it being external, which, for such a device, would necessitate additional parts/space and an overall dimension increase. It can be easily adjusted for ware between the yoke-type device and the eccentric device, and the connecting device, because a single adjustment element is intrinsic to the design of the connecting device. It is environmental contamination resistant because the eccentric device's immobilization working surfaces are internal to the yoke-type device and the connecting device. It can be easily disassembled for maintenance or repair because it can be equipped with a keying element that can be removed by removing one fastener. It employs the yoke-type device and the connecting device for instillation of a caliper-type tilt-brake. It employs the eccentric device and the connecting device for instillation of a safety lock to prevent inadvertent engagement or disengagement of the eccentric device. It is structurally and functionally heavy duty relative to the hinge-type device's size and construction materials.

I claim as my invention:

1. In an eccentrically immobilized hinge-type device, the combination comprising: a yoke-type device, having peripheral elements radially centered on said yoke-type device's axis, with each said element housing a bore on said axis, and said yoke-type device having an implement coupling element; an eccentric device having radially centered first peripheral elements individually disposed for cooperating with a said bore of said yoke-type device, and said eccentric device having at least one eccentric peripheral element disposed adjacent to each said first peripheral element; a connecting device, disposed for cooperating with all said eccentric peripheral elements of said eccentric device and all said peripheral elements of said yoke-type device, and having another implement coupling element; and an activating means for said eccentric device, such that, upon activation it controls the hinging ability between said yoke-type device and said connecting device.

2. In an eccentrically immobilized hinge-type device, the combination comprising: a yoke-type device, having peripheral elements radially centered on said yoke-type device's axis, with each said element housing a bore on said axis that has an anti-friction, non-metallic, surface having a Shore Hardness greater than D60, and said yoke-type device having an implement coupling element; an eccentric device, having first peripheral elements radially centered on an axis, with all said peripheral elements individually having an anti-friction, non-metallic, surface with a Shore Hardness greater than D60, disposed for cooperating with a said bore of said yoke-type device, and said eccentric device having at least one eccentric peripheral element disposed adjacent to each said first peripheral element, and said eccentric device having a keying element that retains radial alignment of all said peripheral elements; a connecting device, disposed for cooperating with all said eccentric peripheral elements of said eccentric device and all said peripheral elements of said yoke-type device, and having another implement coupling element; and an activating means for said eccentric device, such that, upon activation it controls the hinging ability between said yoke-type device and said connecting device.

3. In an eccentrically immobilized hinge-type device, the combination comprising: a yoke-type device, having peripheral elements radially centered on said yoke-type device's axis, with each said element housing a bore on said axis that has an anti-friction, metallic, surface with a Brinnel Hardness (10-mm tungsten carbide ball, 3,000 kg. load) within the range of 165–223, and said yoke-type device having an implement coupling element; an eccentric device, having first peripheral elements radially centered on an axis, with all said peripheral elements individually having an anti-friction, metallic, surface with a Brinnel Hardness (10-mm tungsten carbide ball, 3,000 kg. load) greater than 223, disposed for cooperating with a said bore of said yoke-type device, and said eccentric device having at least one eccentric peripheral element disposed adjacent to each said first peripheral element, and said eccentric device having a keying element that retains radial alignment of all said peripheral elements; a connecting device, disposed for cooperating with all said eccentric peripheral elements of said eccentric device and all said peripheral elements of said yoke-type device, and having another implement coupling element; and an activating means for said eccentric device, such that, upon activation it controls the hinging ability between said yoke-type device and said connecting device.

4. In an eccentrically immobilized hinge-type device, the combination comprising: a yoke-type device, having peripheral elements radially centered on said yoke-type device's axis, with each said element housing a bore on said axis that has an anti-friction, metallic, surface with a Brinnel Hardness (10-mm tungsten carbide ball, 3,000 kg. load) greater than 223, and said yoke-type device having an implement coupling element; an eccentric device, having first peripheral elements radially centered on an axis, with all said peripheral elements individually having an anti-friction, metallic, surface with a Brinnel Hardness (10-mm tungsten carbide ball, 3,000 kg. load) greater than 223, disposed for cooperating with a said bore of said yoke-type device, and said eccentric device having at least one eccentric peripheral element disposed adjacent to each said first peripheral element, and said eccentric device having a keying element that retains radial alignment of all said peripheral elements; a connecting device, disposed for cooperating with all said eccentric peripheral elements of said eccentric device and all said peripheral elements of said yoke-type device, and having another implement coupling element; and an activating means for said eccentric device, such that, upon activation it controls the hinging ability between said yoke-type device and said connecting device.

5. In an eccentrically immobilized hinge-type device, the combination comprising: a yoke-type device, having peripheral elements radially centered on said yoke-type device's axis, with each said element housing a bore on said axis, and said yoke-type device having an implement coupling element; anti-friction sleeve bushings, with all said bushings individually disposed for cooperating with a said bore of said yoke-type device; an eccentric device, having first peripheral elements radially centered on an axis, with all said peripheral elements individually disposed for cooperating with a bore surface of a said bushing, and said eccentric device having at least one eccentric peripheral element disposed adjacent to each said first peripheral element, and said eccentric device having a keying element that retains radial alignment of all said peripheral elements; a connecting device, disposed for cooperating with all said eccentric peripheral elements of said eccentric device and all said peripheral elements of said yoke-type device, and having another implement coupling element; and an activating means for said eccentric device, such that, upon activation it controls the hinging ability between said yoke-type device and said connecting device.

6. In an eccentrically immobilized hinge-type device, the combination comprising: a yoke-type device, having peripheral elements radially centered on said yoke-type device's axis, with each said element housing a bore on said axis, and said yoke-type device having an implement coupling element; anti-friction dual sleeve bushing assemblies, with half of the number of said bushings individually disposed for securely cooperating with a said bore of said yoke-type device; an eccentric device, having first peripheral elements radially centered on an axis, with all said peripheral elements individually disposed for securely cooperating with a bore of the second half of the number of said bushings that are individually disposed for cooperating with a bore of the first said half of said bushings, and said eccentric device having at least one eccentric peripheral element disposed adjacent to each said first peripheral element, and said eccentric device having a keying element that retains radial alignment of all said peripheral elements; a connecting device, disposed for cooperating with all said eccentric peripheral elements of said eccentric device and all said peripheral elements of said yoke-type device, and having another implement coupling element; and an activating means for said eccentric device, such that, upon activation it controls the hinging ability between said yoke-type device and said connecting device.

7. In an eccentrically immobilized hinge-type positioner, the combination comprising: a yoke-type device, having peripheral elements radially centered on said yoke-type device's axis, with each said element housing a bore on said axis, and said yoke-type device having an implement coupling element; anti-friction rolling bearing assemblies with all said bearing assemblies individually having a radially outermost element disposed for securely cooperating with a bore of said yoke-type device; an eccentric device, having first peripheral elements radially centered on an axis, with all said peripheral elements individually disposed for securely cooperating with a radially innermost element of a said bearing assembly, and said eccentric device having at least one eccentric peripheral element disposed adjacent to each said first peripheral element, and said eccentric device having a keying element that retains radial alignment of all said peripheral elements; a connecting device, disposed for cooperating with all said eccentric peripheral elements of said eccentric device and all said peripheral elements of said yoke-type device, and having another implement coupling element; and an activating means for said eccentric device, such that, upon activation it controls the hinging ability between said yoke-type device and said connecting device.

8. In an eccentrically immobilized hinge-type positioner, the combination comprising: a yoke-type device, having peripheral elements radially centered on said yoke-type device's axis, with each said element housing a bore on said axis, and said yoke-type device having an implement coupling element; anti-friction needle bearing assemblies with all said bearing assemblies individually having a radially outermost element disposed for securely cooperating with a bore of said yoke-type device; an eccentric device, having first peripheral elements radially centered on an axis, with all said peripheral elements individually disposed for securely cooperating with a radially innermost element of a said bearing assembly, and said eccentric device having at least one eccentric peripheral element disposed adjacent to each said first peripheral element, and said eccentric device having a keying element that retains radial alignment of all said peripheral elements; a connecting device, disposed for cooperating with all said eccentric peripheral elements of said eccentric device and all said peripheral elements of said yoke-type device, and having another implement coupling element; and an activating means for said eccentric device, such that, upon activation it controls the hinging ability between said yoke-type device and said connecting device.

9. In an eccentrically immobilized hinge-type positioner, the combination comprising: a yoke-type device, having peripheral elements radially centered on said yoke-type device's axis, with each said element housing a bore on said axis, and said yoke-type device having an implement coupling element; anti-friction needle bearing assemblies with all said bearing assemblies individually having a radially outermost element disposed for securely cooperating with a bore of said yoke-type device; an eccentric device, having first peripheral elements radially centered on an axis, with all said peripheral elements individually disposed for securely cooperating with a radially innermost element of a said bearing assembly, and said eccentric device having at least one eccentric peripheral element disposed adjacent to each said first peripheral element and disposed for cooperating with a keying element with an axis central to said first peripheral elements and said keying element retaining radial alignment of all said peripheral elements; a connecting device, disposed for cooperating with all said eccentric peripheral elements of said eccentric device and all said peripheral elements of said yoke-type device, and having another implement coupling element; and an activating means for said eccentric device, such that, upon activation it controls the hinging ability between said yoke-type device and said connecting device.

* * * * *